US006974203B2

(12) United States Patent
Ikeda et al.

(10) Patent No.: US 6,974,203 B2
(45) Date of Patent: Dec. 13, 2005

(54) RECORDING APPARATUS

(75) Inventors: Yasuhiko Ikeda, Kanagawa (JP); Akira Kida, Kanagawa (JP); Noriko Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 820 days.

(21) Appl. No.: 09/977,973

(22) Filed: Oct. 17, 2001

(65) Prior Publication Data

US 2002/0075495 A1 Jun. 20, 2002

(30) Foreign Application Priority Data

Oct. 31, 2000 (JP) ..... 2000-332381

(51) Int. Cl.[7] ..... B41J 23/00
(52) U.S. Cl. ..... 347/37
(58) Field of Search ..... 347/37, 5, 8, 23, 347/49, 101, 108; 400/58, 354

(56) References Cited

U.S. PATENT DOCUMENTS 5,459,496 A * 10/1995 Hanabusa et al. ..... 347/5
5,465,107 A * 11/1995 Mayo et al. ..... 346/139 R
5,867,188 A * 2/1999 Murayama et al. ..... 347/37
6,471,427 B1 * 10/2002 Boyatt et al. ..... 400/354.1

FOREIGN PATENT DOCUMENTS

EP 0 864 426 A2 9/1998
EP 0 983 862 A2 3/2000
EP 1 013 457 A1 6/2000

OTHER PUBLICATIONS

European Search Report dated Apr. 2, 2003, Ref. No. EP 32567, De Groot, R.

* cited by examiner

*Primary Examiner*—Shih-Wen Hsieh
(74) *Attorney, Agent, or Firm*—Fitzpatrick, Cella, Harper & Scinto

(57) ABSTRACT

An ink jet recording apparatus is provided with a conveying roller for conveying a recording sheet, and a carriage that enables a recording head for recording on the recording sheet by discharging ink droplets to the recording sheet to reciprocate in the direction intersecting the conveying direction of the recording medium along a guide shaft having a substantially circular lateral section. The bearing portion of the carriage is structured to be in contact with the guide shaft at two points A and B on the upstream side and downstream side in the aforesaid conveying direction with respect to the vertical line running through the center of the guide shaft. Each of angles θa and θb formed in the directions of tangential line and vertical line on the outer circumference of the guide shaft at the contact points A and B is set to make the frictional force generated between the guide shaft and the bearing portion larger than the force generated at the time of the carriage being accelerated to cause the bearing portion to slide in the circumferential direction of the guide shaft.

5 Claims, 4 Drawing Sheets

RECORDING APPARATUS

BACKGROUND OF THE INVENTION

1. Field of the Invention

The present invention relates to a recording apparatus structured to enable the carriage that holds a recording head to perform main scanning in the direction intersecting the conveying direction of a recording medium (sub-scanning direction).

2. Related Background Art

Conventionally, the recording apparatus provided with such function as a printer, a copying machine, and a facsimile equipment, among some others, or used as an output device of a complex electronics apparatus including a computer, a word processor, or the like or used as that of a work station, has been structured to record images on a recording material (recording medium) such as a recording sheet or a thin plastic sheet in accordance with image information. An apparatus of the kind is classified into that of ink jet type, wire-dot type, thermal type, and laser beam type, among some others, by the recording method adopted for each of them.

With the serial type recording apparatus which adopts the serial scanning type that scans in the direction (main scanning direction) intersecting the conveying direction of a recording material (sub-scanning direction), images of one line portion are recorded by recording means mounted on the carriage that reciprocates in the main scanning direction. After the one line portion is completely recorded, the recording material is conveyed by a designated amount in the sub-scanning direction. Then, images of one line portion are further recorded by the aforesaid recording means. With the repetition of these operations, recording is made entirely on the recording material.

Of the above recording apparatuses, the ink jet type recording apparatus (ink jet recording apparatus) that uses the serial scanning method performs recording by discharging ink from the recording head serving as recording means to a recording material to facilitate making recording means compact for a highly precise recording of images at a high speed. There are also advantages that it can record on an ordinary paper without any particular treatment given thereto, thus making the running costs lower, and that being non-impact type, it can operate recording in a lesser amount of noise, and recording images in colors with ease using multiple color ink as well.

Particularly, recording means (ink jet recording head) of ink jet type that discharges ink by utilization of thermal energy can be manufactured easily with liquid paths arranged in high density (discharge port arrangement) by structuring on a base plate the electrothermal converting elements, electrodes, liquid flow path walls, a ceiling plate, and some others, through the semiconductor manufacturing process, such as etching, vapor deposition, sputtering, hence enabling recording means to be made compact still more.

For the recording apparatus of serial scanning type described above, it is necessary to move the recording head stably in order to obtain a clear and high quality result of recording. Therefore, the cylindrical bearing portion of the carriage must slide in a state of maintaining a specific precision with respect to the columnar guide shaft that guides the carriage. Thus, the guide shaft and the bearing portion of the carriage should be controlled to make the dimensional tolerance between them as small as possible.

Particularly, for the ink jet recording method, non-contact recording should be performed with a clearance of approximately 1 mm between the recording head and recording medium, it is required to stabilize the traveling of the carriage more reliably in order to obtain recorded images in higher precision.

However, even if it is attempted to make a structure so that the dimensional tolerance is minimized between the guide shaft and the bearing portion of the carriage, there is still a need for the provision of certain clearance between them in order to enable the bearing portion of the carriage to slide on the guide shaft smoothly. Furthermore, the possible dimensional variation due to the temperature changes should also be taken into account. Then, it becomes necessary to provide a greater clearance here. Now, even when the guide shaft and the bearing portion are formed by the material that may present a smaller dimensional variation resulting from the temperature changes, the clearance should become approximately 50 $\mu$m at the maximum including the processing tolerance. As a result, for the recording apparatus of 600 dpi (600 pixels per inch (2.54 cm)), there is a possibility that deviation of one pixel or more occurs in the impact positions of ink droplets on a recording medium.

SUMMARY OF THE INVENTION

The present invention aims to provide the recording apparatus that enables the carriage to travel without generating vibration in a state of maintaining a specific precision with respect to the guide shaft even if a certain clearance is given between the guide shaft and the bearing portion of the carriage.

Another object of the invention is to provide an ink jet recording apparatus capable of recording images in high precision quietly with the bearing portion of the carriage being made not to float from the guide shaft when the carriage is accelerated so as to suppress the noise and vibration at the time of acceleration.

Still another object of the invention is to provide a recording apparatus comprises a carriage for enabling a recording head for recording on a recording medium to reciprocate in the direction intersecting the conveying direction of the recording medium, the carriage reciprocating by driving power transmitted from driving means to the drive transmitting portion of the carriage; a guide shaft having a substantially circular lateral section for guiding the carriage to reciprocate in the aforesaid intersecting direction; and a bearing portion provided for the carriage to slide along the guide shaft, the bearing portion being installed substantially on either side in the direction of the reciprocal traveling. Here, the aforesaid bearing portion is structured to be in contact with the guide shaft at two points on the upstream side and downstream side in the aforesaid conveying direction of the recording medium with respect to the direction of the vertical line running through the center of the guide shaft, and each angle, which is formed in the directions of the tangential line on the outer circumference of the guide shaft and the vertical line at each of the contact points between the bearing portion and the guide shaft, is set to make the friction force generated between the guide shaft and the bearing portion larger than the force generated at the time of the carriage being accelerated to cause the bearing portion to slide in the circumferential direction of said guide shaft.

DETAILED DESCRIPTION OF THE PREFRRED EMBODIMENTS

Now, with reference to the accompanying drawings, the description will be made of the embodiments in accordance with the present invention.

Figure 1:
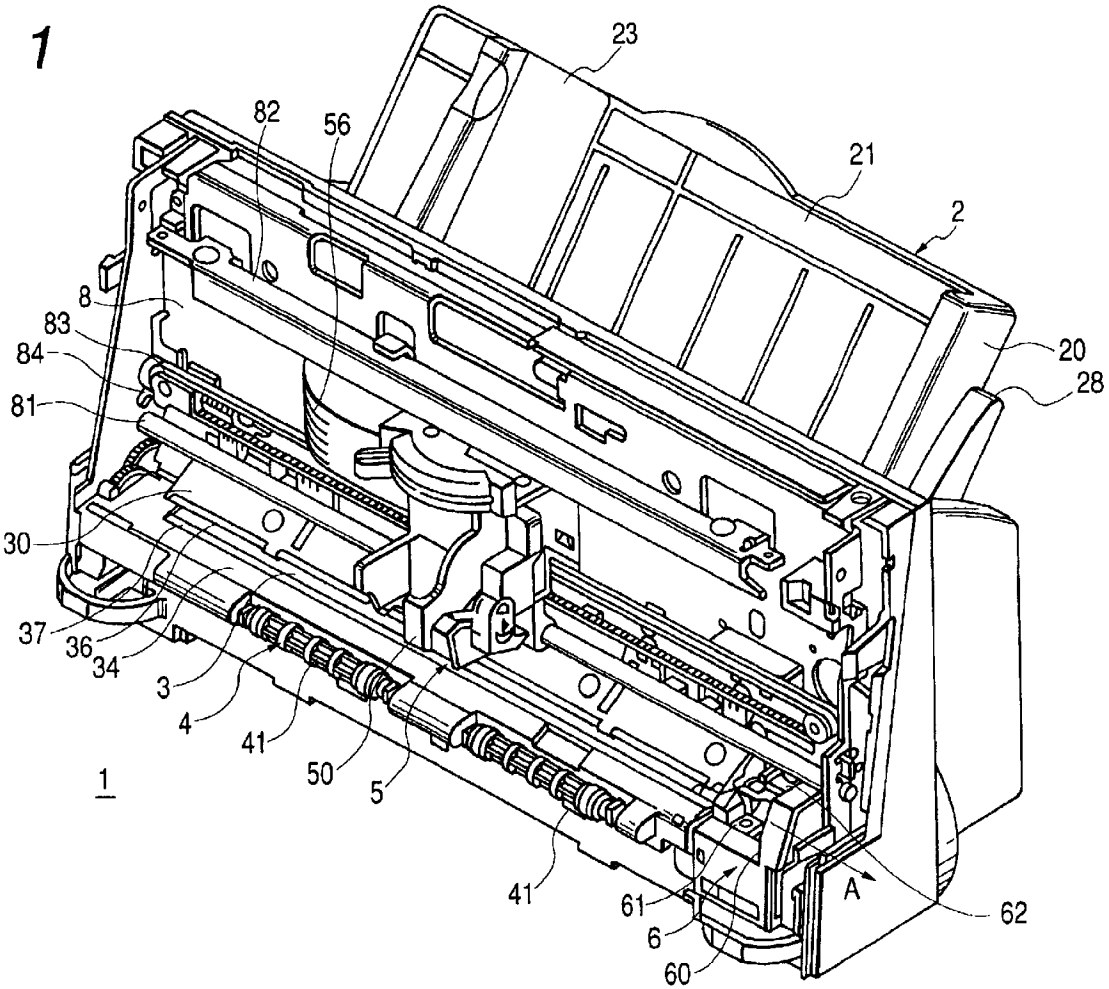
FIG. 1 is a perspective view which shows the entire structure of a recording apparatus in accordance with one embodiment of the present invention.
Figure 2:
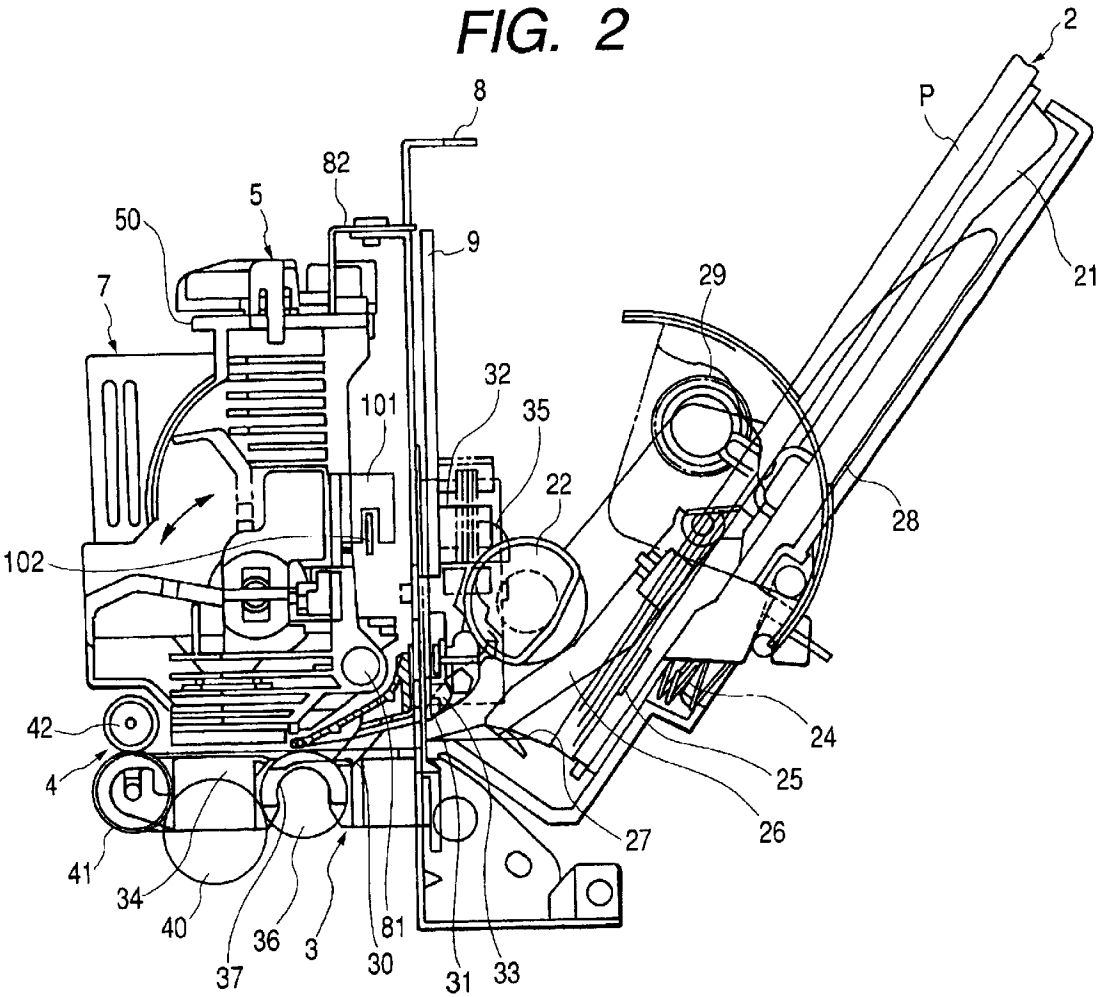
FIG. 2 is a front view which shows the recording apparatus represented in FIG. 1.
Figure 3:
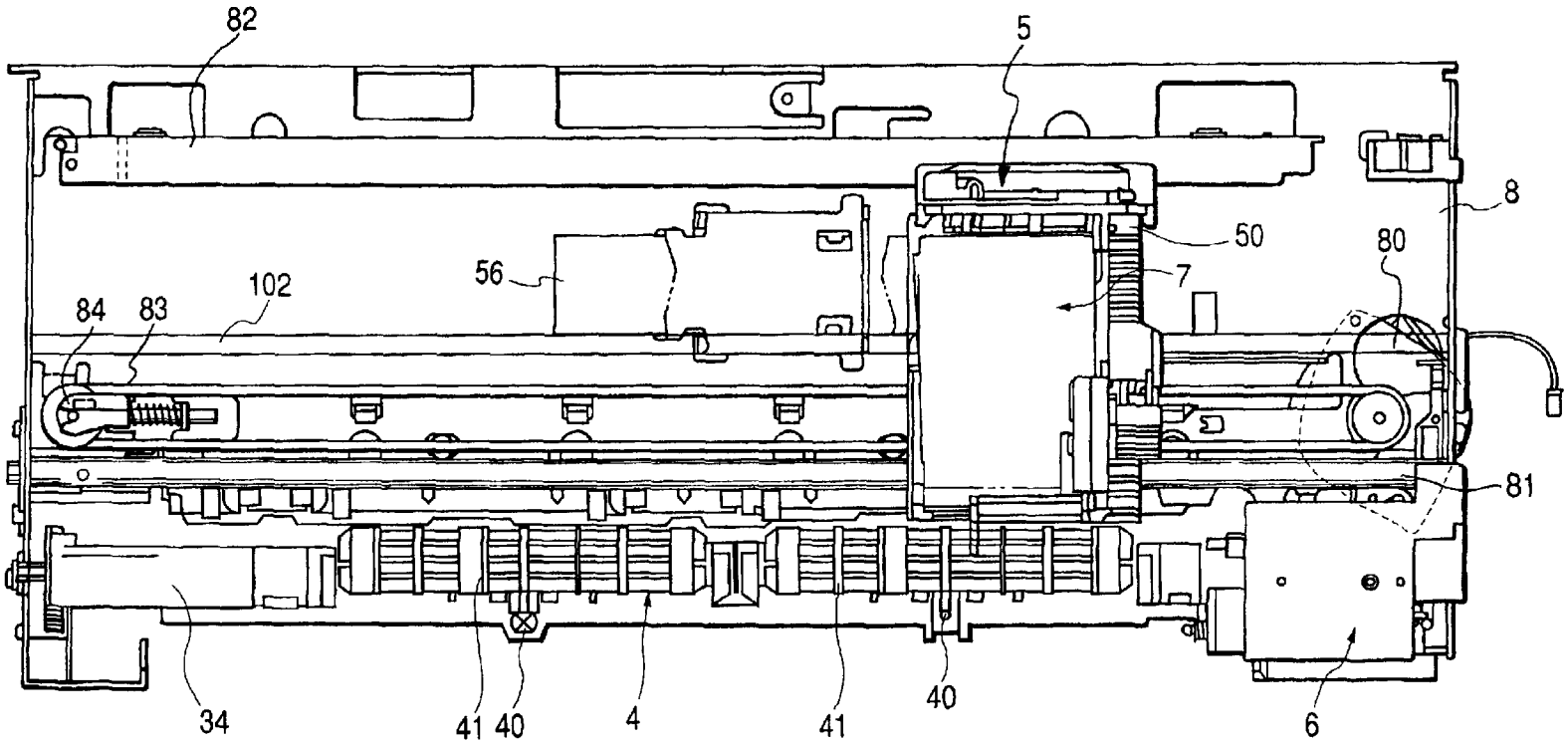
FIG. 3 is a side sectional view which shows the recording apparatus represented in FIG. 1.

At first, FIG. 1 to FIG. 3 are views which illustrate schematically the structure of a recording apparatus in accordance with the present invention. FIG. 1 is a perspective view which shows the entire structure of the recording apparatus embodying the present invention. FIG. 2 is a front view of the recording apparatus. FIG. 3 is a side sectional view of the recording apparatus.

The recording apparatus 1 of the present embodiment comprises a sheet feeding portion 2 that automatically feeds a recording sheet P serving as a recording medium to the interior of the recording apparatus 1; a sheet conveying portion 3 that further conveys the recording sheet P fed to the interior of the recording apparatus 1; and a sheet expelling portion 4 that expels the recording sheet P conveyed by the sheet conveying portion 3 to the outside of the recording apparatus 1. The recording apparatus 1 comprises a carriage portion 5 that includes a carriage 50 reciprocating along a guide shaft 81 in the direction (main scanning direction) intersecting the conveying direction of the recording sheet P (sub-scanning direction), and a cleaning portion 6 that cleans the ink discharge surface of an ink jet recording head 7 (see FIG. 2) mounted on the carriage 50.

Hereunder, the description will be made of the outlines of these structures one by one.

(A) Sheet Feeding Portion 2

The sheet feeding portion 2 is structured by fixing to a base 20 the pressure plate 21 that stacks recording sheets P thereon, and the feed rotation member 22 that feeds a recording sheet P. For the pressure plate 21, a movable side guide 23 is arranged movably. The movable side guide 23 regulates the stacking position of the recording sheets P on the pressure plate 21. The pressure plate 21 is rotational around the shaft coupled with the base 20, and biased by a pressure plate spring 24 to the feed rotation member 22. The portion of the pressure plate 21 that faces the feed rotation member 22 is provided with a separation pad 25 formed by a material having a large friction coefficient, such as an artificial leather, to prevent the double feed of recording sheets P. Further, for the base 20, there are provided a separation nail 26 covering the corner of the recording sheet P in one direction in order to separate the recording sheets P one by one; a bank portion 27 formed integrally with the base 20 to separate cardboards or the like that cannot be separated by use of the separation nail 26; a switching lever 28 for switching the separation nail 26 to enable it to act in the ordinary sheet position, but to disable the separation nail 26 to act in the cardboard position; and a release cam 29 to release the contact between the pressure plate 21 and the feed rotation member 22.

With the structure thus arranged, the release cam 29 presses the pressure plate 21 to a designated position on standby. In this state, the contact between the pressure plate 21 and the feed rotation member 22 is released. Then, in such state, the driving power of a conveying roller 36 to be described later is transmitted to the feed rotation member 22 and the release cam 29 through gears or the like. Then, the release cam 29 is caused to part from the pressure plate 21 to enable the pressure plate 21 to rise. The feed rotation member 22 abuts against the recording sheet P to begin feeding sheet by picking up the recording sheet P along the rotation of the feed rotation member 22. The recording sheets P is separated one by one by use of the separation nail 26 and fed to the sheet conveying portion 3. The feed rotation member 22 and the release cam 29 rotate until the recording sheet P is fed into the sheet conveying portion 3, and then, to be on standby where the contact between the recording sheet P and the feed rotation member 22 is again released. The transmission of the driving power from the conveying roller 36 is cut off.

(B) Sheet Conveying Portion

The sheet conveying portion 3 comprises the conveying roller 36 that conveys the recording sheet P, and a PE sensor 32 for detecting the leading end of the recording sheet P and the passage of the trailing end thereof. The pinch roller 37, which follows the rotation of the conveying roller 36, is arranged in a state of being in contact with the conveying roller 36. The pinch roller 37 is held by a pinch roller guide 30 and biased by a pinch roller spring 31 to be pressed to the conveying roller 36, thus generating force to convey the recording sheet P. Further, at the entrance of the sheet conveying portion 3 to which the recording sheet P is fed, an upper guide 33 and a platen 34 are arranged to guide the recording sheet P. Also, for the upper guide 33, a PE sensor lever 35 is provided to get the detection of the leading end or trailing end of the recording sheet P across to the PE sensor 32. Further, on the downstream side of the conveying roller 36 in the conveying direction of the recording sheet, there is arranged a head cartridge 7 provided with an ink jet recording head (not shown) to form images by discharging onto the recording sheet P in accordance with image information, and an ink tank (not shown) to contain ink to be supplied thereto.

With the structure described above, the recording sheet P fed to the sheet conveying portion 3 is guided by means of the platen 34, the pinch roller guide 30, and the upper guide 33 to be conveyed to the roller pair formed by the conveying roller 36 and pinch roller 37. At this time, the PE sensor lever 35 detects the leading end of the recording sheet P thus fed, and the printing position of the recording sheet P is obtained accordingly. Also, the recording sheet P is conveyed on the platen 34 by the roller pair 36 and 37, which rotate by use of an LF motor (not shown).

Here, in this case, the ink jet recording head, which is integrally structured with an ink tank and made easily exchangeable, is used for the head cartridge 7. The head cartridge 7 is arranged to be able to give heat to ink by use of heater or the like installed in the nozzle of the recording head. Then, film boiling is generated in ink by heat thus given, and ink liquid droplet is discharged from the nozzle of the recording head by means of the pressure changes caused by the growth and shrinkage of the bubble generated by such film boiling, thus forming images on the recording sheet P.

(C) Carriage Portion

The carriage portion 5 is provided with a carriage 50 having the head cartridge 7 mounted thereon. The carriage 50 is supported by the guide shaft 81 which enables the carriage 50 to reciprocate for scanning in the directions at right angles to the conveying direction of the recording sheet P, and also, by the guide rail 82 which regulates the rotation of the carriage 50 around the guide shaft 81, while holding the upper rear end of the carriage 50 to maintain the clearance between the head cartridge 7 and the recording sheet P. The guide shaft 81 and the guide rail 82 are fixed to a chassis 8. In this respect, the guide shaft 81 has a shape of laterally circular section. Also, for the carriage 50, a bearing portion (not shown) that slides on the guide shaft 81 is arranged, respectively, in the vicinity of both sides in the direction of reciprocal traveling thereof.

The carriage 50 is driven a carriage motor 80 fixed to the chassis 8 though a timing belt 83. The timing belt 83 is tensioned and supported by an idle pulley 84. Further, carriage 50 is provided with a flexible cable 56 for transmitting recording signals from an electric base plate 9 to the head cartridge 7. Also, on the carriage 50, a linear encoder 101 is mounted to detect the carriage position. The linear encoder 101 reads line numbers of a linear scale 102 installed on the chassis 8 to detect the position of the carriage 50. The positional signal of the carriage 50 thus read by the linear encoder 101 is transmitted to the electric base plate 9 for processing through the flexible cable 56.

With the structure arranged as described above, the recording sheet P is conveyed by use of the roller pair 36 and 37 to the line position (the position of the recording sheet P in the conveying direction) to form images when an image formation is executed on the recording sheet P, while the carriage 50 is moved to the column position (the position perpendicular to the conveying direction of the recording sheet P) to form images by means of feedback control using the carriage motor 80 and the linear encoder 101, thus enabling the head cartridge 7 to face the position of the image formation. After that, in accordance with signals from the electric base plate 9, the head cartridge 7 forms imaged by discharging ink onto the recording sheet P.

(D) Sheet Expelling Portion

The sheet expelling portion 4 is arranged so that a transmitting roller 40 abuts against the conveying roller 36, and, further, the transfer roller 40 abuts against a sheet expelling roller 41. As a result, the driving power of the conveying roller 36 is transmitted to the sheet expelling roller 41 through the transmitting roller 40. Also, a spur 42 is in contact with the sheet expelling roller 41 to be rotational following the rotation of the sheet expelling roller 41. With the structure thus arranged, the recording sheet P having images formed thereon by use of the carriage portion 5 is nipped between the sheet expelling roller 41 and the spur 42 to be conveyed and expelled onto a tray or the like (not shown) to receive the expelled sheet.

(E) Cleaning Portion

The cleaning portion 6 is formed by a pump 60 for cleaning the ink discharge surface (nozzle opening surface) of the head cartridge 7; a cap 61 for preventing the head cartridge 7 from being dried; and a drive switching arm 62 for switching the driving power from the conveying roller 36 to the sheet feeding portion 2 and the pump 60. The drive switching arm 62 fixes a planet gear (not shown) that rotates around the axial center of the conveying roller 36 at the time other than the sheet feeding operation or the cleaning operation. As a result, the driving power from the conveying roller 36 is not transmitted to the sheet feeding portion 2 and the pump 60. With the movement of the carriage 50, the drive switching arm 62 shifts in the direction indicated by an arrow A in FIG. 1. Then the planet gear becomes free, thus enabling the planet gear to move in accordance with the regular/reverse rotations of the conveying roller 36. When the conveying roller 36 rotates regularly, the driving power is transmitted to the sheet feeding portion 2. When its rotation is reversed, the driving power is transmitted to the pump 60.

Next, the carriage portion 5 will be described in detail in accordance with the present invention.

As shown at 3 in FIG. 1, each component is fixed to the carriage 50 to form a portion. The carriage portion 5 can reciprocate for scanning along the guide shaft 81 and the guide rail 82 by arranging the bearing portion of the carriage 50 of the carriage portion 5 that passes the guide shaft 81 to be fixed to the chassis 8 and slide it on the guide rail 82 which is also fixed to the chassis 8. On the backside of the carriage 50, a timing belt 83 is fixed. The portion of the carriage 50 where the timing belt 83 is fixed becomes the drive transmitting portion to which driving power is transmitted from driving means formed by a carriage motor 80 and the timing belt 83.

The timing belt 83 is tensioned around the pulley 801 fixed to the shaft of the carriage motor 80 fixed to the chassis 8 and the idle pulley 84 fixed to the chassis 8 for giving tension to the timing belt 83. As a result, with the regular and reverse driving of the carriage motor 80, driving power is transmitted to the carriage portion 5 through the timing belt 83 for the reciprocal scanning along the guide shaft 81 and the guide rail 82.

The position of the carriage 50 can be grasped exactly even during its operation when the linear encoder 101 reads the line numbers of the linear scale 102. In the initial setting operation of the recording apparatus, the carriage 50 moves toward the right side end of the chassis 8 in FIG. 1. Then, the carriage 50 abuts against a certain position and does not move any more, where changes are no longer observable in the signals from the linear encoder 101. This position is the referential position (home position) thereof. Also, when the carriage 50 moves toward the left end side in FIG. 1, which is opposite to the referential position, the carriage 50 abuts against a certain position likewise and does not move any more, where changes are no longer observable in the signals from the linear encoder 101.

Figure 4:
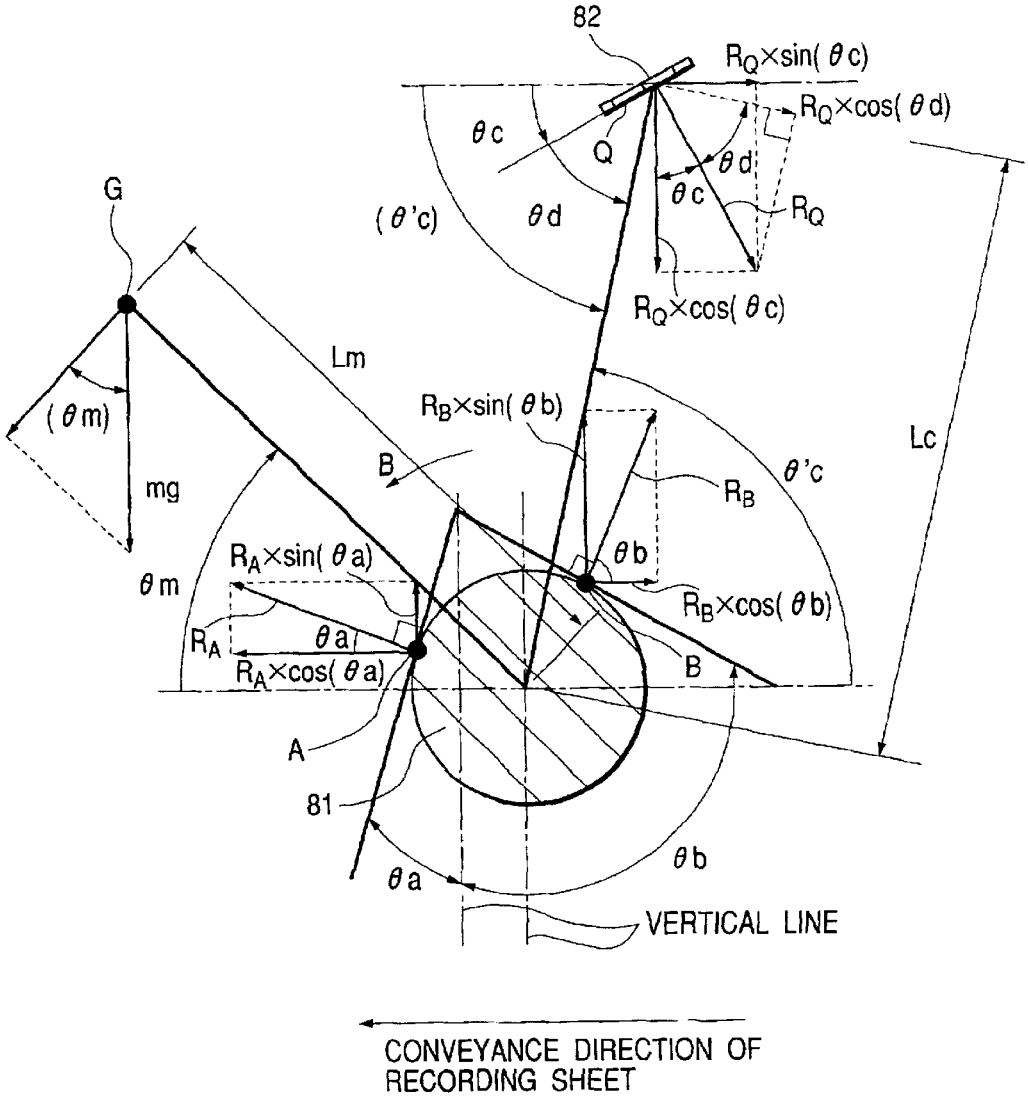
FIG. 4 is a view which schematically shows the positional relations between the guide shaft, the guide rail, the center of gravity of the guide shaft, and the like in the carriage portion of the recording apparatus represented in FIG. 1, which is represented in a state of being observed from the side end of the recording apparatus.

FIG. 4 is a view which schematically shows the positional relations between the guide shaft 81, the guide rail 82 and the center of gravity or the like of the carriage 50 in the carriage portion 5 of the aforesaid recording apparatus in a state of being observed from the side end of the recording apparatus. In this respect, each reference mark used in FIG. 4 means the following, respectively:

- m: carriage mass
- g: gravitational acceleration
- Lm: distance from the center of the guide shaft 81 to the gravity of the carriage 50
- θm: angle formed by the horizontal axis and the line segment Lm
- Lc: distance from the center of the guide shaft 81 to the guiding surface of the guide rail 82 of the carriage 50
- $R_Q$: reaction received by the carriage 50 from the guide rail 82
- θ'c: angle formed by the horizontal axis and the line segment Lc
- θc: angle formed by the horizontal axis and the guide surface of the guide rail 82
- θd: angle formed by the guiding surface of the guide rail 82 and the line segment Lc (θd=θ'c−θc)

Also, the points A and B indicate each of the contacts of the bearing portion with the guide shaft 81, respectively, and the contact point A is arranged on the downstream side of a recording sheet P in the conveying direction thereof with respect to the line in the vertical direction that runs through the center of the guide shaft 81. The contact point B is arranged on the upstream side in the conveying direction with respect to the line in the vertical direction.

At this juncture, with the carriage 50 being at rest, each of reactions $R_A$, $R_B$, and $R_Q$ received by each of the contact points A and B, and guiding surface Q of the guide rail 82 is expressed by the following formula, respectively:

$$R_A = \frac{mg}{\sin(\theta a + \theta b)}\left\{\frac{Lm \times \cos(\theta m)}{Lc \times \cos(\theta d)} \times \cos(\theta c - \theta b) + \cos(\theta b)\right\}$$

$$R_B = \frac{mg}{\sin(\theta a + \theta b)}\left\{\frac{Lm \times \cos(\theta m)}{Lc \times \cos(\theta d)} \times \cos(\theta c + \theta a) + \cos(\theta a)\right\}$$

$$R_Q = mg \times \frac{Lm \times \cos(\theta m)}{Lc \times \cos(\theta d)}$$

Here, acting force on each of the aforesaid contact points is caused to change if the carriage 50 is accelerated during its traveling. When accelerated, force is exerted by the driving force of the timing belt 83 to cause the bearing portion of the carriage 50 to slide in the circumferential direction (direction B in FIG. 4) of the guide shaft 81. Also, there exists friction force between the bearing portion and the guide shaft 81. At the time of acceleration, if the aforesaid driving force becomes greater than the friction force with respect to the contact point A on the side nearer to the gravity of the bearing portion of the carriage 50 on the side in the advancing direction and the contact point B on the side farther away from the gravity of the bearing portion on the opposite side in the advancing direction, the bearing portion is caused to slide in the circumferential direction of the guide shaft 81, and the carriage 50 floats by the amount of clearance between the guide shaft 81 and the bearing portion. As a result, not only the noise is generated during the traveling of the carriage 50, but also, vibration is not attenuated even when the carriage 50 is conditioned to run at the constant speed, leading to the degradation of recorded images.

On the other hand, if each of the angles θa and θb at each of the contact points A and B of the bearing portion, which is formed on the circumference of the guide shaft 81 in the directions of the tangential line and vertical line, should be set to be too acute in order to prevent the carriage 50 from floating at the time of acceleration, the sliding load generated between the guide shaft 81 and each of the bearing portions become larger, hence necessitating the torque required for the carriage motor 80 to be made larger accordingly. Also, in this case, the amount of frictional war on each of the bearing portions becomes greater. Thus, when the recording apparatus is used for a long time in this condition, the clearance between the ink discharge surface of the recording head and a recording sheet P is caused to become smaller eventually.

Under such circumstances, there is a need for setting each of the angles θa and θb such as to avoid the floating of the carriage 50 at the time of acceleration, but not to allow the bearing portion to be affected easily by loads or friction wear. These angles must be determined in consideration of the distance between each of the bearing portions arranged on each side of the carriage 50 in the directions of reciprocal traveling; the distance between the timing belt 83 and the bearing portion; the weight of the carriage 50; the gravitational position G of the carriage 50; the friction coefficient $\mu$ between the guide shaft 81 and the bearing portion; the positional relations between the guide shaft 81 and the guide rail 82; and the accelerating/decelerating speed of the carriage 50.

For example, if the positional relations between the positions of the contact points between each bearing portion of the carriage 50 and the guide shaft 81, and the center of gravity G or the like of the carriage 50 are as shown in FIG. 4, it should be good enough to set each of the aforesaid angles θa and θb so that given the reaction of the force added to the drive transmitting portion of the carriage 50 at the time of acceleration as Fa, the value, which is arrived at by multiplying the sum of resistance to the contact point A on the side nearer to the gravitational center of the bearing portion in the advancing direction of the carriage 50 and Fa·cos θa by friction coefficient $\mu$, becomes larger than Fa·Sin θa, and also, the value, which is arrived at by multiplying the sum of resistance to the contact point B on the side farther away from the gravitational center of the bearing portion on the opposite side in the advancing direction and Fa·cos θb by friction coefficient $\mu$ becomes larger than Fa·sin θb. Also, in the positional relations shown in FIG. 4, it is possible to set the angel θa with respect to the contact point A to be smaller than the angle θb with respect to the contact point B, that is, to be set at (θa>θb). With the relations between the angles θa and θb being defined in this manner, the sliding load between the guide shaft 81 and each of the bearing portions becomes smaller to make it possible to suppress the floating of the carriage 50 at the time of acceleration, while to minimize the amount of frictional wear of bearing portions each at the contact point A and B.

Also, as the mode of the recording apparatus of the present invention, it is possible to adopt that of a copying machine combined with reader or the like or further that of a facsimile equipment provided with the function of transmission and reception, beside the one functioning as the image output terminal of information processing equipment, such as word process or computer, irrespective of being formed integrally therewith or separately therefrom.

As described above, for the recording apparatus embodying the present invention, each of the angles at the two contact points between the bearing portion and the guide shaft, which is formed in the directions of tangential line on the outer circumference of the guide shaft and the vertical line, is set so as to make the frictional force generated between the guide shaft and the bearing portion larger than the force that may cause the bearing portion to slide in the circumferential direction of the guide shaft when the carriage is accelerated. Therefore, even if a structure is arranged to provide a certain clearance between the guide shaft and the bearing portion, it becomes possible to enable the carriage to travel on the guide shaft in a state of maintaining a specific precision with respect to the guide shaft, and to perform recording images in better condition.

Also, in accordance with the present embodiment, the recording apparatus regulates the carriage to rotate around the guide shaft, while it further provides the guide rail that guides the carriage so that it can reciprocates in the aforesaid intersecting direction. Then, each of the aforesaid angles is set in accordance with the weight of carriage, the gravitational center of the carriage with respect to the guide shaft, the distance between the bearing portions themselves each of which is installed substantially on each side end of the carriage, the frictional coefficient between each bearing portion and the guide shaft, the position of the drive transmitting portion of the carriage in relation to the guide shaft, the position of the guide rail in relation to the guide shaft, and the acceleration given to the carriage. Thus, it is made possible to prevent the bearing portion of the carriage from floating from the guide shaft when the carriage is accelerated, and to suppress the amount of noise, as well as vibration, at the time of acceleration, and then, to quietly record images in high precision.

Further, in accordance with the present embodiment, the recording apparatus is structured so that the angle of each of said angles, which is formed in the directions of tangential line on the outer circumference of the guide shaft and vertical line at the contact point on the downstream side in the conveying direction of a recording medium, is made smaller than the angle formed in the direction of tangential line on the outer circumference of the guide shaft and vertical line at the contact point on the upstream side in the aforesaid conveying direction. In this way, the sliding load between the guide shaft and the bearing portion can be made smaller to minimize the amount of frictional wear, hence making it possible to enhance the durability of the recording apparatus.

What is claimed is:

1. A recording apparatus comprising:

a carriage for enabling a recording head for recording on a recording medium to reciprocate in a direction intersecting a conveying direction of said recording medium, said carriage reciprocating by driving power transmitted from driving means to a drive transmitting portion of said carriage;

a guide shaft having a substantially circular lateral section for guiding said carriage to reciprocate in said intersecting direction; and a bearing portion provided for said carriage to slide along said guide shaft, said bearing portion being installed substantially on either side in the direction of said reciprocal traveling, wherein said bearing portion is structured to be in contact with said guide shaft at two points on an upstream side and downstream side in the conveying direction of said recording medium with respect to the direction of a vertical line running through the center of said guide shaft, and each angle formed in the directions of a tangential line on an outer circumference of said guide shaft and the vertical line at each of the contact points between said bearing portion and said guide shaft is set to make a friction force generated between said guide shaft and said bearing portion larger than the force generated at a time of said carriage being accelerated to cause said bearing portion to slide in the circumferential direction of said guide shaft.

2. A recording apparatus according to claim 1, wherein a structure is arranged to make the angle, of each of said angles, formed in the directions of tangential line and vertical line on the outer circumference of said guide shaft at said contact point on the downstream side in said conveying direction smaller than the angle formed in the directions of tangential line and vertical line on the outer circumference of said guide shaft at said contact point on the upstream side in said conveying direction.

3. A recording apparatus according to claim 1, further comprising:

a guide rail for regulating a rotation of said carriage around said guide shaft, while guiding said carriage to reciprocate in said intersecting direction, wherein each of said angles is set in accordance with a weight of said carriage, a gravitational position of said carriage with respect to said guide shaft, a distance between said bearing portion portions themselves installed substantially on either side of said carriage, respectively, a friction coefficient between said bearing portion and said guide shaft, a position of said drive transmitting portion with respect to said guide shaft, and an acceleration and deceleration given to said carriage.

4. A recording apparatus according to claim 3, wherein of each of said angles, the angle formed in the directions of tangential line and vertical line on the outer circumference of said guide shaft at said contact point on the downstream side in said conveying direction is made smaller than the angle formed in the directions of tangential line and vertical line on the outer circumference of said guide shaft at said contact point on the upstream side in said conveying direction.

5. A recording apparatus according to either one of claim 1 to claim 4, wherein said recording head is an ink jet recording head for forming images on said recording medium by discharging ink liquid droplets from nozzles of said recording head.

* * * * *

UNITED STATES PATENT AND TRADEMARK OFFICE

CERTIFICATE OF CORRECTION

PATENT NO. : 6,974,203 B2
DATED : December 13, 2005
INVENTOR(S) : Yasuhiko Ikeda et al.

It is certified that error appears in the above-identified patent and that said Letters Patent is hereby corrected as shown below:

Column 1,
Line 21, “the” should read -- this --; “into that” should read -- as --; and
Line 22, “of” should be deleted.

Column 10,
Line 37, “either” should read -- any --.

Signed and Sealed this

Thirtieth Day of May, 2006

JON W. DUDAS
*Director of the United States Patent and Trademark Office*